US012534266B1

(12) United States Patent
Monroe, Jr. et al.

(10) Patent No.: US 12,534,266 B1
(45) Date of Patent: Jan. 27, 2026

(54) CUT RESISTANT AND HIGHLY TRANSLUCENT TOTE

(71) Applicant: Armored Outdoor Gear Inc., Flagstaff, AZ (US)

(72) Inventors: Thomas Anthony Monroe, Jr., Flagstaff, AZ (US); James Martin Bell, Flagstaff, AZ (US)

(73) Assignee: ARMORED OUTDOOR GEAR INC., Flagstaff, AZ (US)

( * ) Notice: Subject to any disclaimer, the term of this patent is extended or adjusted under 35 U.S.C. 154(b) by 88 days.

(21) Appl. No.: 18/233,550

(22) Filed: Aug. 14, 2023

Related U.S. Application Data

(63) Continuation-in-part of application No. 17/151,179, filed on Jan. 17, 2021, now Pat. No. 11,723,446, which is a continuation-in-part of application No. 16/027,134, filed on Jul. 3, 2018, now Pat. No. 10,893,734.

(Continued)

(51) Int. Cl.

| | |
|---|---|
| ***B65D 6/08*** | (2006.01) |
| ***A45C 3/00*** | (2006.01) |
| ***A45C 13/18*** | (2006.01) |
| *A45F 3/04* | (2006.01) |

(52) U.S. Cl.

CPC ..... *B65D 7/14* (2013.01); *A45C 3/001* (2013.01); *A45C 13/185* (2013.01); *B65D 7/20* (2013.01); *A45C 2003/002* (2013.01); *A45C 2200/10* (2013.01); *A45F 3/04* (2013.01)

(58) Field of Classification Search

CPC ... A45C 13/185; A45C 2200/10; A45C 3/001; A45C 3/06; A45C 2003/002; B65D 7/14; B65D 7/20

See application file for complete search history.

(56) References Cited

U.S. PATENT DOCUMENTS 1,367,207 A * 2/1921 Rowan ..... A45C 13/04 150/124
1,368,082 A * 2/1921 Wiener ..... A45C 3/06 150/123

(Continued)

FOREIGN PATENT DOCUMENTS

EP 3078771 A1 * 10/2016 ..... A45C 3/00
GB 2359012 B 7/2003

(Continued)

*Primary Examiner* — Nathan J Jenness
*Assistant Examiner* — Jennifer Castriotta
(74) *Attorney, Agent, or Firm* — Invention To Patent Services; Alex Hobson

(57) ABSTRACT

A cut resistant and highly translucent tote utilizes a multi-layer knitted metal fabric having a knitted metal outside layer and a knitted metal inside layer. These two knitted layers may be independent in a portion of the tote, such as in a clear-view portion of the tote, configured to allow clear visibility of items retained in the tote. The independent layers of knitted fabric are highly cut resistant, as they can flex in multiple direction and also move and slide with respect to each other. The tote may have a gusseted base with a base-side sleeve extending at the intersection of the base and sides to allow the tote to be free standing. An opening in the top of the tote may have a closure feature, such as hook-and-loop fastener material.

20 Claims, 15 Drawing Sheets

Related U.S. Application Data

(60) Provisional application No. 62/528,525, filed on Jul. 4, 2017.

(56) References Cited

U.S. PATENT DOCUMENTS

| | | | | |
|---|---|---|---|---|
| 1,814,378 | A | 7/1931 | Gilbertson et al. | |
| 1,915,196 | A | 6/1933 | McGuire | |
| 4,979,833 | A | 12/1990 | Cook | |
| 5,118,201 | A | 6/1992 | Cook | |
| 6,244,081 | B1 | 6/2001 | Schlipper | |
| 6,684,404 | B2 | 2/2004 | Bachner | |
| 7,069,753 | B2 | 7/2006 | Schlipper | |
| 7,913,839 | B2 | 3/2011 | Fawcett et al. | |
| 9,161,596 | B2 | 10/2015 | Schlipper | |
| 9,854,890 | B2 | 1/2018 | Godshaw et al. | |
| 9,932,764 | B2 | 4/2018 | Mcmurray | |
| 10,145,044 | B2 * | 12/2018 | Schenk | D04B 21/20 |
| 2002/0021844 | A1 | 2/2002 | Rusert et al. | |
| 2006/0042327 | A1 * | 3/2006 | Hummel | D04B 1/14 66/202 |
| 2007/0240798 | A1 | 10/2007 | Bihler | |
| 2016/0353850 | A1 | 12/2016 | Halpern | |

FOREIGN PATENT DOCUMENTS

| | | | | |
|---|---|---|---|---|
| WO | 2009036657 | A1 | 3/2009 | |
| WO | WO-2011009112 | A2 * | 1/2011 | D04B 1/22 |

* cited by examiner

CUT RESISTANT AND HIGHLY TRANSLUCENT TOTE

CROSS REFERENCE TO RELATED APPLICATIONS

This application is a continuation in part of U.S. patent application Ser. No. 17/151,179, filed on Jan. 17, 2021, which is a continuation in part of U.S. patent application Ser. No. 16/027,134, filed on Jul. 3, 2018 and issued as U.S. Pat. No. 10,893,734 on Jan. 19, 2021, which claims the benefit of U.S. Provisional patent application No. 62/528,525, filed Jul. 4, 2017; the entirety of all former applications are hereby incorporated by reference herein.

BACKGROUND OF THE INVENTION

Field of the Invention

This application is directed to a cut resistant and highly transparent tote comprising a multiply knitted metal fabric.

Background

Many venues now require the public to carry a translucent bag or have their bags searched before entering. Transparent plastic bags and totes are available; however, they provide very little security from theft, whereby a thief can easily cut through the bag with a knife and/or razor and remove valuables that are easily seen through the translucent bag. There exists a need for a tote or bag that is highly translucent or transparent and that is cut resistant.

Many backpackers and campers take measures to keep rodents and other animals from getting to their food. In some cases, a food bag is tied up around a tree limb, but rodents can sometimes still make their way to the bag. In addition, there are no suitable trees in many hiking location, such as above tree line or in the desert and canyon hiking. Rodent deterrent enclosures are available; however, they are typically made of rigid metal enclosures that do not pack well and/or take up too much room in the pack. There exists a need for a flexible fabric tote or bag that is made of a material that prevents rodents from chewing therethrough.

SUMMARY OF THE INVENTION

The invention is directed to a cut resistant and highly transparent tote comprising a multilayer knitted metal fabric. The tote of the present invention may be used as a food storage tote for backpacking and camping as the multiply knitted metal fabric prevents rodents from chewing therethrough. The flexibility of fabric layers and the two or multiply arrangement of independent layers makes the knitted metal fabric very cut and chew through resistant. Knitted fabrics are made from relatively few numbers of strands and therefore have very few free ends. In addition, a knitted fabric has less contact surface area when layered on a second knitted fabric layer than typical woven materials, and this reduced friction enhances slip and cut through resistance. The tote of the present invention may be used to carry articles into venues, as the knitted metal fabric is highly translucent as it has a high percentage of open area. The clear view portion of an exemplary tote may comprise a knitted metal fabric that is highly translucent having an open area of at least 50% or more, about 70% or more, about 80% or more, about 90% or more and any range between and including the percentages provided. This high open area of the knitted metal fabric allows security to easily see the contents therein. In addition, an exemplary tote of the present invention comprises a clear-view portion, or portion that comprises only the knitted metal fabric, and this clear view portion may be a substantial portion of the tote, or about 70% of the area or more, about 80% of the area or more, about 90% of the area of more and any range between and including the percentages provided. The tote allows clear visibility of contents therein and is also cut resistant, thereby preventing thieves from slicing through the tote to remove valuables retained therein. In addition, the top of the tote may comprise a closure feature that makes it difficult for a thief to open. The tote may have dimensions to meet requirements of venues. For example, the NFL requires bags or totes of no more than 12 inch by 12 inch by 6 inches and the totes of the present invention may fit within these dimensions. The tote of the present invention may have a dimension, such as length width or depth that is at least 75 mm or more about 100 mm or more, about 150 mm or more, about 200 mm or more, about 250 mm or more and any range between and including the dimensions provided. The tote may be large enough to carry items including food items, personal gear including cell phones, binoculars and the like.

An exemplary tote comprises a multiply knitted metal fabric, such as a two-ply knitted metal fabric comprising two layers of knitted metal, a knitted metal outside layer and a knitted metal inside layer. The layers of the knitted metal fabric may be independent layers, wherein the layers are not attached to each other and can independently move or slip across each other. This improves the cut through resistance, as the individual layers can slide to relieve shear. The knitted metal fabric may be an interloped knit wherein the strands are looped around each other to provide some range of motion, displacement and flexibility of the fabric. The flexible nature of the knitted metal fabric also increases cut through resistance, as it allows for displacement of shear and cutting forces.

An exemplary knitted metal fabric may comprise, consist essentially of, or consist of metal strands and these metal strands may be steel, such as stainless steel, nickel, aluminum, copper, titanium and the like. In some embodiments, the strands comprise a metallic coating or plating that may improve the hardness of the strand and/or improve corrosion resistance. For example, a nickel coated steel will have the benefits of the hard and low-cost steel and the corrosion resistance of nickel. The stands may be round in cross-section to further improve flexibility but may have a polygonal cross-section. In an exemplary embodiment, the strands of the metal fabric have a size of about 30 American Wire Gauge (AWG) or larger, about 29 AWG or larger, about 28 AWG or larger, about 26 AWG or larger, about 24 AWG or larger, about 22 AWG or larger, or between about 30 AWG and 22 AWG. If the strands are too large, the fabric may lose flexibility and the fabric may not slide in an effectively way to resist cutting. If the strands are too small, they may be more easily cut through. For this reason, a preferred range is about 30 AWG to about 26 AWG. The AWG number correlates to a millimeter size of wire, wherein 30 AWG is about 0.255 mm in diameter, 29 AWG is about 0.286 mm in diameter, 28 AWG is about 0.33 mm in diameter, 26 AWG is about 0.4 mm in diameter, 24 AWG is about 0.5 mm in diameter, 22 AWG is about 0.63 mm in diameter, 20 AWG is about 0.81 mm in diameter and 18 AWG is about 1.0 mm in diameter.

An exemplary knitted metal fabric may have a strand (wire) diameter or width of about 0.127 mm (0.005 in) or more, 0.178 mm (0.007 in) or more, 0.203 mm (0.008 in) or more, 0.254 mm (0.01 in) or more, 0.381 mm (0.015 in) or more and any range between and including the values provided. If the strand diameter is too small, the knitted metal fabric may be susceptible to rodents chewing through the fabric and if it is too large, the fabric may be too stiff and less flexible.

An exemplary knitted metal fabric may have an opening density or (openings/inch) of about 40 or more, about 50 or more, about 60 or more, about 70 or more, about 80 or more, about 100 or more, and any range between and including the values provided. A preferred range of opening density may be between 60 and 90 and even more preferably between about 70 and 80 and most preferably between about 74 and 78, to provide effective translucency and effective structure for support and rodent prevention.

An exemplary tote is cut resistant wherein a pocket knife or utility knife will not cut through the multilayer metal fabric. A utility knife with a razor blade can be pressed down manually and drug across the multilayer metal fabric with the blade held at about 45 degrees to the metal fabric without cutting through the fabric or the strands of the fabric. The exemplary two-ply knitted metal fabric can withstand this test without being cut through.

An exemplary tote forms and enclosure having a top opening and a closure feature to secure the top opening in a closed position, wherein the front and back of the tote are brought together and retained along the top. A closure feature may comprise a hook-and-loop fastener, a zipper, a plurality of snaps or buttons and the like. A preferred closure is a hook-and-loop fastener or zipper that extends along the top opening of the tote. The closure feature may be configured on a top-opening sleeve that may extend around the perimeter of the top of the tote and around the end of the knitted metal fabric. The top opening sleeve may wrap over the top of the multiply metal fabric, from the inside to the outside of the tote. A top opening sleeve may cover the ends of any loose strands that extend from the top of the knitted metal fabric. In another embodiment, a closure feature may comprise a flap that extends from the one side to the opposing side of the tote, such as from the front to the back or from one side to another. A user may extend the flap over the opening and secure a hook-and-loop fastener configured on the flap to an opposing hook-and-loop fastener on the opposing side of the top opening sleeve.

An exemplary tote may be made from a continuous sleeve of multiply knitted metal fabric having a perimeter and length. The sleeve may be formed into a tote having a desired shape by crimping the multiply metal fabric to form an edge between sides or surfaces. An exemplary tote comprises a plurality of crimped edges that are formed in the knitted metal fabric to create a shape. For example, a knitted metal fabric may be crimped along the sides to form a side crimped edge that extends from the top opening sleeve to the base of the tote. A tote may be in the shape of an envelope with two parallel front and back sides or surfaces formed by crimped edges sides extending along the left and right sides. The crimp in an envelope type tote bends the multiply knitted metal fabric substantially 180 degrees, such that the front and back sides extend parallel to each other. A tote may have a gusseted base or bottom and have a block shape, with a front surface, back surface, left and right surfaces and a base surface. A base coupling and/or sleeve may extend around the free ends of the multiply knitted metal fabric along the base to form the enclosure. A block-shaped tote may have two side crimped edges that extend along each of the left and right sides, one along the intersection of the front surface and the side and one along the intersection of the back surface and the side. The crimped edges extending along the sides may form substantially orthogonal surfaces wherein the multiply knitted metal fabric is crimped to form substantially 90 degree bends from one surface to the other, or within about 10 degrees of 90 degrees. The woven metal fabric may hold the crimped shape, as the metal is deformed beyond an elastic yield point. The distance between the side crimped edges on the left or right side may be the depth of the tote. Likewise, a gusseted base tote may comprise bottom crimped edges that extend along the intersection of the front surface and the base, and along the back surface and the base, as well as along the interface of each side and the base, to produce a rectangular base. A sleeve may extend along the crimped edges, or along a coupled portion of the base, wherein two free ends of the knitted metal fabric are coupled together. The sleeve may extend from side to side and extend along the middle of the base, about half way from the front to the back surfaces.

An exemplary cut resistant and translucent tote may have a planar base to better enable the tote to stand upright. An exemplary tote may have a round or circular base and be coupled with a continuous sleeve that extends up to the top opening. The continuous sleeve may form a tube extending up from the base. The top of the tubular sleeve may have a top-opening sleeve and a closure feature, as described herein.

An exemplary cut resistant and translucent tote may be configured as a backpack, wherein the tote has shoulder straps for extending over the shoulders of a person. The backpack tote may be carried on the back or on the front of a person. An exemplary backpack tote may have a front side, or side facing the person when donned, that comprises fabric and in some cases padding. The multilayer knitted metal fabric may extend along the back side or surface of the backpack to form said tote.

An exemplary cut resistant and translucent tote may be configured as a cooler utensil tote and may have one or more receptables formed for receiving and retaining utensils such as cutlery, spoons, knives, forks, spatulas, tongs and the like. The exemplary cooler utensil tote may be configured to extend over a cooler and may have loops or hoops for receiving a strap therethrough to retain the cooler utensil tote to the cooler.

An exemplary tote may comprise one or more grommets that extend through a surface, or multiple surfaces of the tote. A grommet may be used to couple a strap or rope to the tote. A grommet may extend through a sleeve portion of the tote and also through the knitted metal fabric. In an exemplary embodiment, a tote has a grommet in the top-opening sleeve and the grommet couples the front and back surfaces together. In another exemplary embodiment, a tote has two grommets configured in the top-opening sleeve and proximal the left and right sides to allow a carrying strap to be retained therein.

An exemplary tote has clear-view portion that is highly translucent, thereby making it easy to view contents within the tote. A clear-view portion may be a substantial portion of the surface area of the tote and may extend from the bottom of the top-opening sleeve to the base. A clear-view portion may extend along the front, back, and both the left and right sides of the tote, making identification of articles possible from any side of the tote.

Also described herein is a lock cable that comprises a multilayer metal fabric and preferably multiple layers of a knitted metal fabric, as this type of metal fabric is highly resistant to cut-through. The multilayer metal fabric and a fabric layer may be layered or rolled to form the lock cable extension. A lock coupler extension, such as a cut resistant cable, may be centrally located in the middle of the lock cable with the multilayer metal fabric configured around it. The multilayer metal fabric may be a jelly-roll within the lock cable which may enable free movement of each layer to resist cutting. An exemplary lock cable may have a lock element, such as a lock insertion portion and lock receiver portion coupled to the lock coupler that extends along an interior and along the length of the lock cable. The lock elements may be made of hard metal that is cut resistant. A pair of lock rings may be coupled to the lock coupler with one on a first end and one on the opposing second end. The lock cable may be wrapped around an article and a pad lock may be inserted into through the two lock rings to secure the lock cable around the article. A lock cable may comprise an integral lock ring, wherein the lock cable is turned back on itself to make a loop and the extended end is coupled to the lock cable, such as by a crimp that is swaged around the extended end and lock cable extension.

Also described herein is an insect flying disc that comprises a metal fabric configured in a circular shape with a sleeve extending therearound. The central portion may be a single layer or multilayer metal fabric and may have a clear-view area that is highly translucent, as described herein. The sleeve may be a fabric sleeve that extends around the metal fabric and is secured with a stitch, for example. A resilient ring such as a spring steel ring may be configured within the sleeve and allow the insect flying disc to be folded to a smaller dimension for storage. The resilient ring will cause the insect flying disc to pop open to form the disc shape from a restrained orientation. The insect flying disc can be thrown to capture insects in the air and may land over insects or other animals to keep them retained under the flying disc.

The insect flying disc and the tote of the present invention may be used for a variety of other purposes wherein a durable open mesh or fabric is required, such as sieving applications, beachcombing, gold panning, a chum bag for fishing bait, and the like. The open nature of the metal fabric may be well suited for such purposes. These compactable articles can be carried into remote areas for a plurality of uses.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
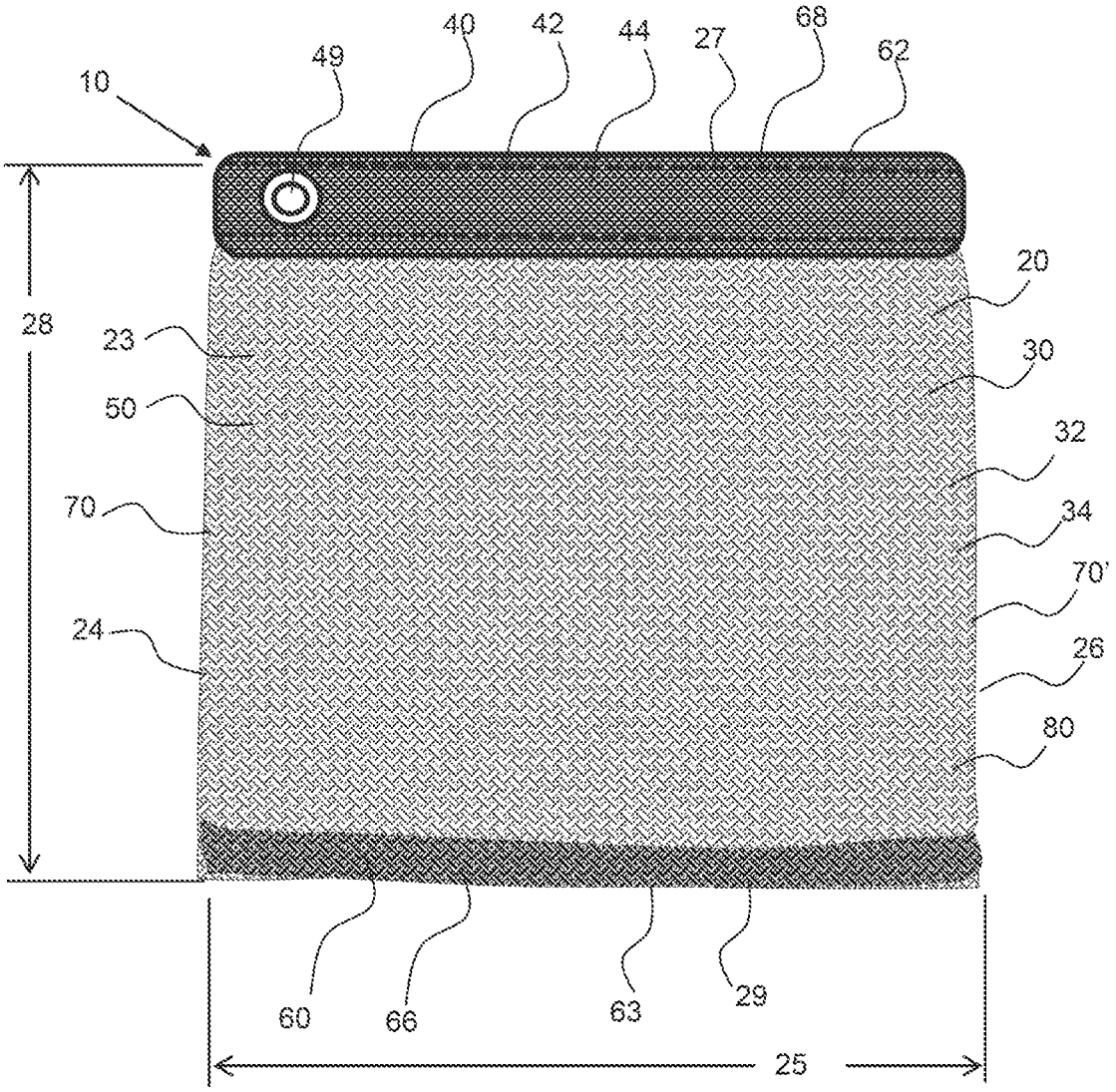
FIG. 1 shows a front view of an exemplary tote of the present invention comprising two unattached layers of knitted metal in the clear-view portion of the tote.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 3:
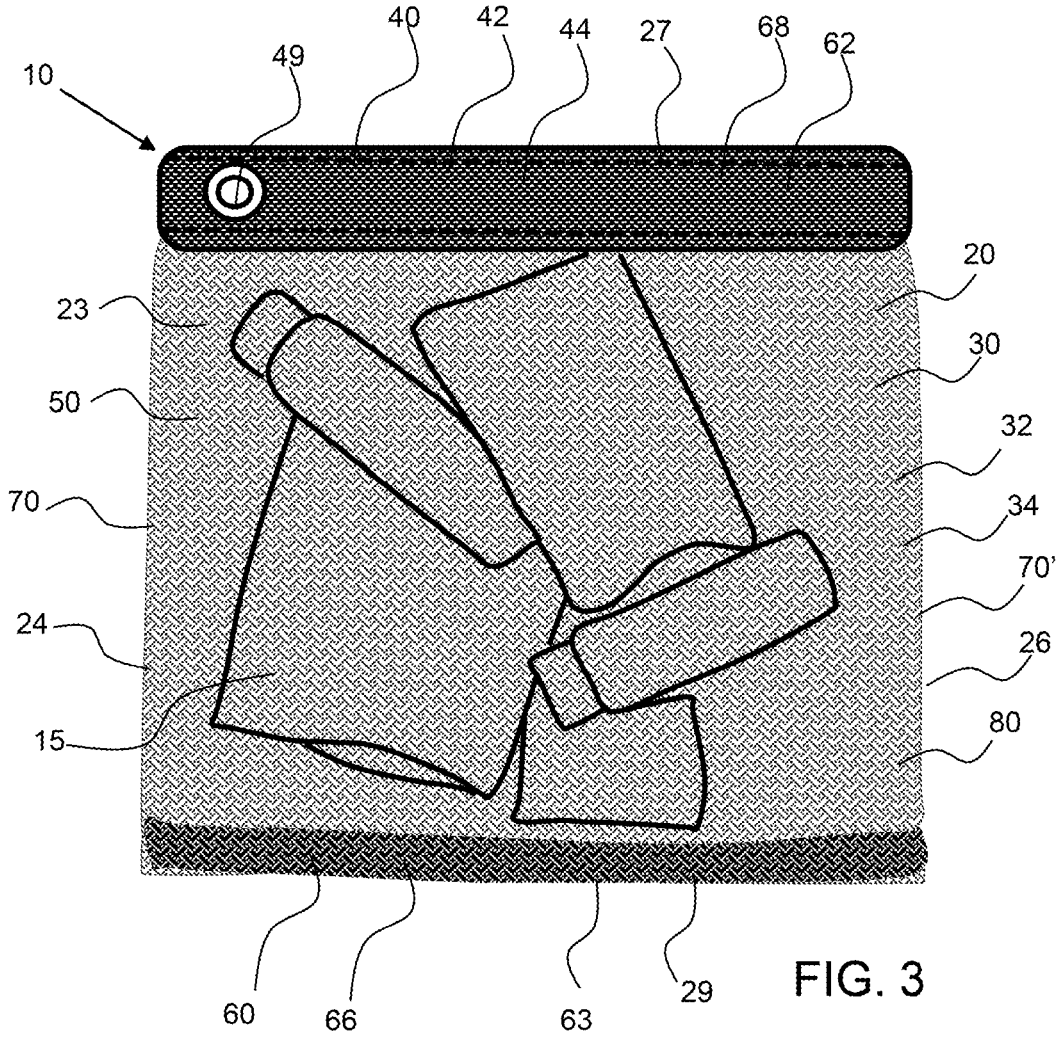
FIG. 3 shows a front view of an exemplary tote of the present invention having articles clearly visible therein.
Figure 4:
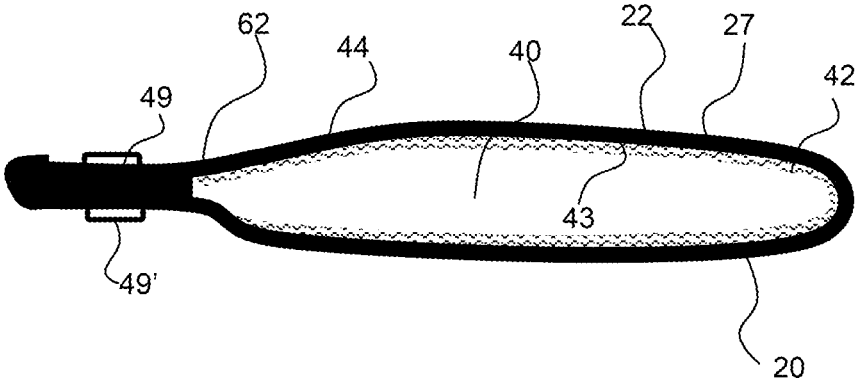
FIG. 4 shows a top view of an exemplary tote having a grommet and closure feature.

Referring now to FIGS. 1 and 4, an exemplary tote 10 comprises a multilayer knitted metal fabric 80 that is translucent, having a high open area, and cut resistant. The multilayer knitted metal fabric 80 may be a fabric sleeve 23 consisting of the multilayer knitted metal fabric in a continuous sleeve, with no seams along the length of the sleeve, wherein the multilayer knitted metal fabric extends continuously around the perimeter of the sleeve. An exemplary sleeve has a free end at the top and bottom. A clear view portion 50 of the tote, or area that is highly translucent, such as from the top opening sleeve 44 to the base 29, allows article retained therein to be clearly viewed. A crimped edge 70, 70' extends from the top-opening sleeve 44 to the base 29 to create an envelope shaped tote with parallel front 20 and back 22 surfaces. The exemplary tote comprises a multilayer knitted metal fabric 80, such as a two-ply knitted fabric 30, comprising independent and unattached layers of an inside layer of knitted metal inside layer 32 and an outside layer of knitted metal outside layer 34, to produce a cut resistant tote having a clear-view portion 50. As shown in FIG. 3, items 15 within the tote are clearly visible.

The exemplary tote has a top opening 40 with a closure feature 42, such as hook-and-loop fastener material 43 or zipper. A top opening sleeve 44, such as a fabric 62, extends over the knitted metal fabric to encapsulate the top edge of the knitted metal fabric. A stitch 68 may extend through this fabric and the multilayer knitted metal fabric 80 to secure the two components together. A grommet 49 extends through the top opening sleeve and the knitted metal fabric to secure the front and back together, as best shown in FIG. 4. The grommet provides a means to secure a strap, clip, a karabiner or other fastener to the tote. The tote has a height 28 from the top 27 to the base 29, or bottom, and a width 25 from the first side 24 to the second side 26. Crimped edges 70 and 70' are configured between the front 20 and back 22 surfaces of the tote in the multilayer knitted metal fabric 80. The crimped edges bend and sets the multilayer knitted metal fabric 80 substantially 180 degrees.

Figure 2:
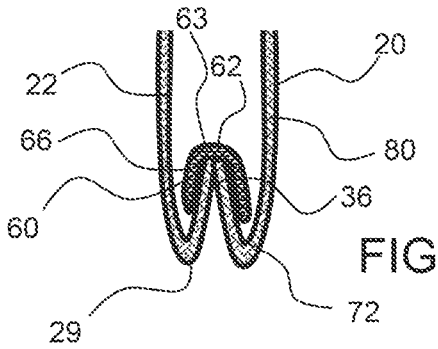
FIG. 2 shows a cross-sectional view of an exemplary base coupling, an inverted sleeve.

A base coupling 60 couples the front and back multilayer knitted metal fabric 80 to form the base 29, as best shown in FIG. 2. The base coupling is an inverted seam 66, wherein the multilayer knitted metal fabric 80 has a base crimp 72 that folds the multilayer knitted metal fabric 80 inward toward the interior of the tote. A sleeve coupler 63, such as fabric 62 extends over the free ends 36 of the multilayer fabric and is secured to each of the free ends together. This inverted seam keeps the free ends of the metal fabric pointed inward.

A clear-view portion 50 extends from the top opening sleeve 44 to the base 29 and comprises or consists of the multilayer knitted metal fabric 80, such as a two-ply metal fabric layer 30. The two-ply metal fabric layer 30 is made up of a knitted metal inside layer 32 and a knitted metal outside layer 34. In an exemplary embodiment, these two layers are unattached in the clear-view portion to allow independent movement to further increase cut through resistance. The open area of the clear view portion may be about 50% or more, about 70% or more, about 80% or more, about 90% or more and any range between and including the percentages provided. The clear view portion layer may be a multi-layer metal fabric sleeve having no seams around the perimeter.

Figure 5:
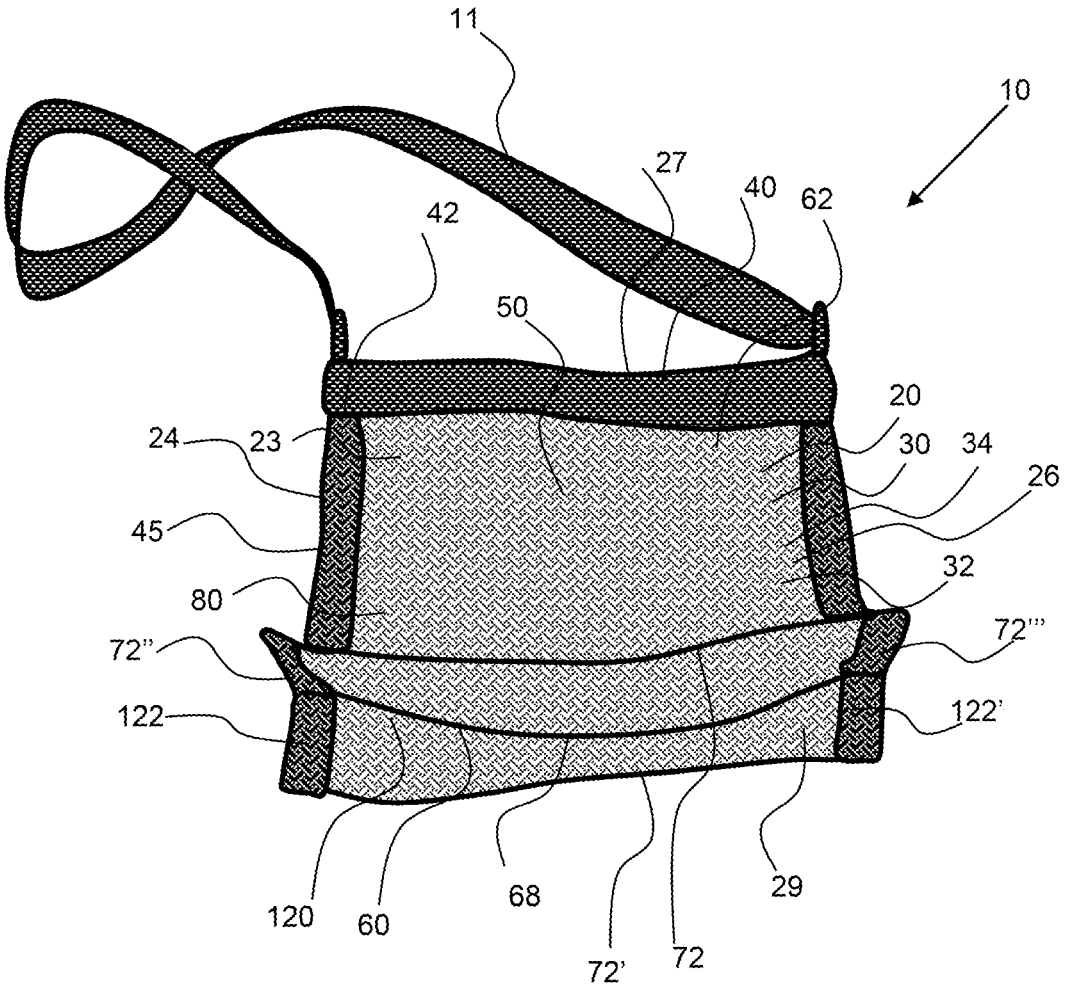
FIG. 5 shows a perspective view of an exemplary tote of the present invention having a gusseted bottom.
Figure 6:
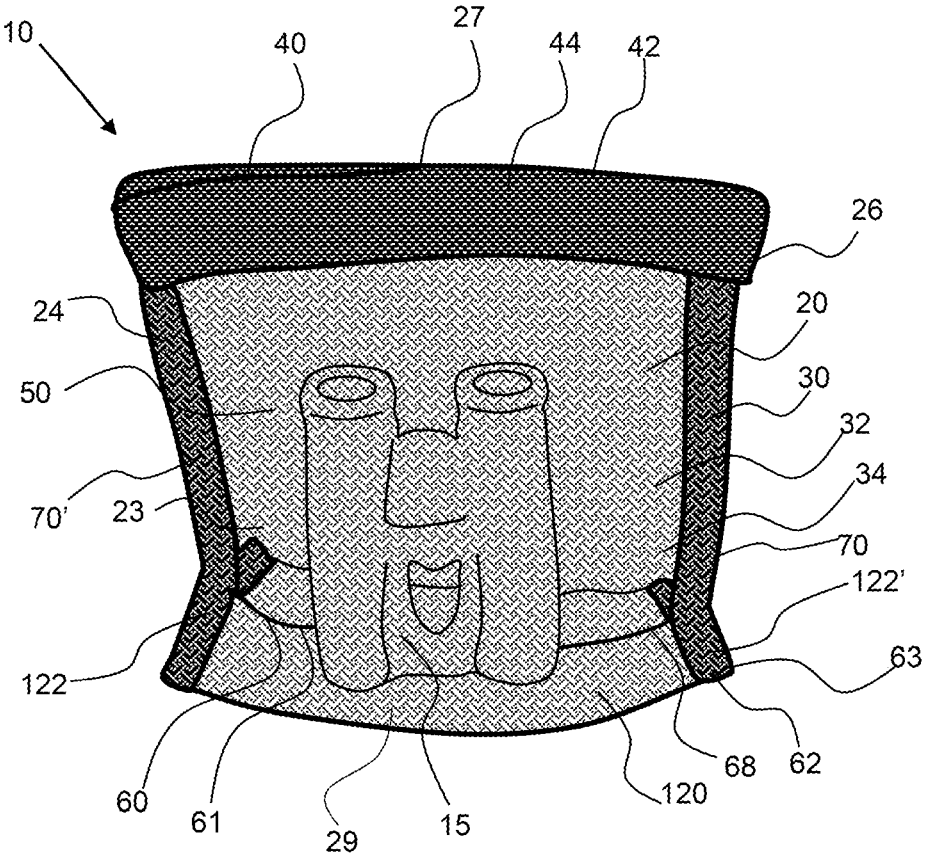
FIG. 6 shows the tote of FIG. 5 with binoculars configured therein and clearly visible through the clear-view portion of the tote.
Figure 7:
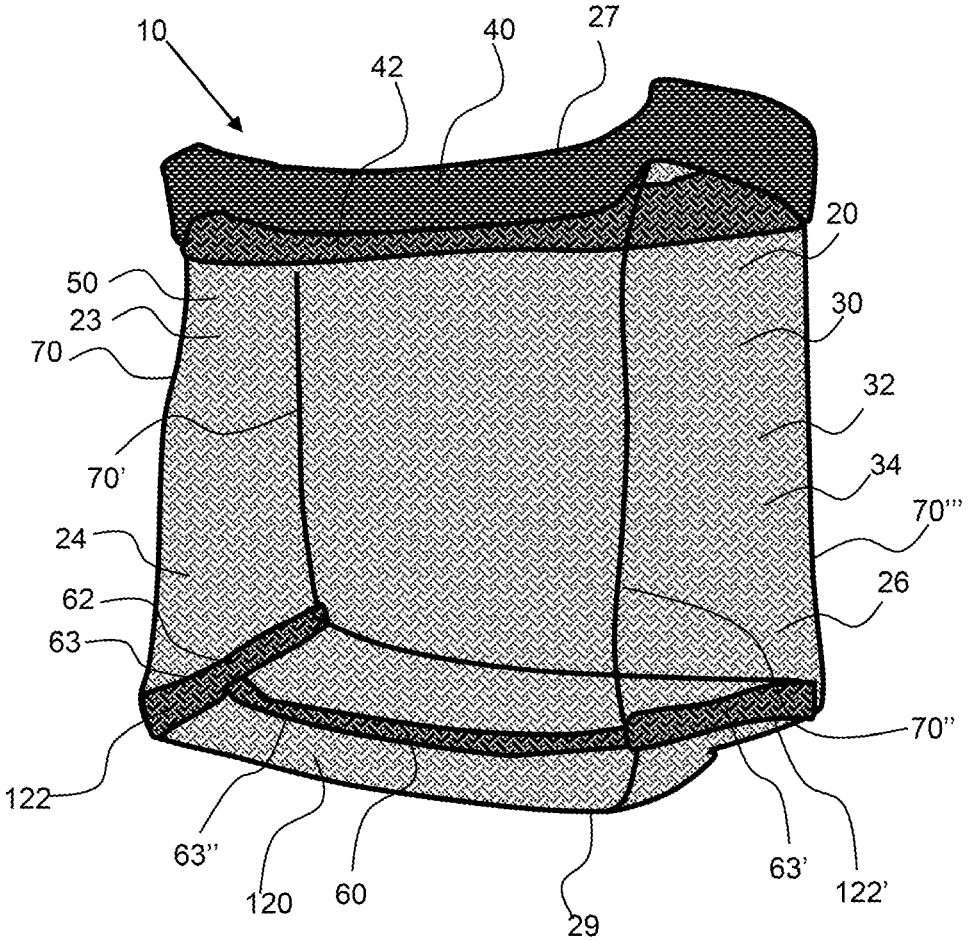
FIG. 7 shows perspective view of an exemplary tote of the present invention having a gusseted bottom.

As shown in FIGS. 5 to 7, an exemplary tote 10 is configured with a gusseted base 120, or bottom that extends horizontally to better enable the tote to stand upright. The tote of the present invention may be free-standing, wherein it will stand upright on the gusseted bottom without additional support. As shown in FIG. 5, a strap 11 is coupled to the tote 10. A gusseted base may be formed by crimped base edges 72, 72' that extends across the base from the first side 24 to the second side 26, or along the front and back, and crimped edges that extend along either side, 72", 72'". The distance between the crimped base edges extending from the front to the back surface may define the depth of the base. Base-side sleeves 122, 122' may extend across the sides of the base. The metal fabric may have a base coupling 60 that extends across the base from the first side to the second side and this coupled portion may have a sleeve coupler 63, such as fabric 62 to cover any loose metal strands and/or to couple edges of the metal fabric together, as shown in FIG. 7, and as shown in FIG. 2. As shown in FIG. 5 and FIG. 6, the base comprises a stich 68 to produce the seam in the multilayer knitted metal fabric 80. As shown in FIGS. 5 and 6, a side sleeve 45 extends along the side of the tote and may extend around a crimped edge of the metal fabric. The tote shown in FIG. 5 and FIG. 6 has a gusseted bottom but only one crimped edge along the two vertical sides to produce an irregular shaped tote. As shown in FIG. 6, the tote is free-standing on the base 29 with an item 15, binoculars, within the interior of the tote. As shown in FIG. 7, side surfaces are formed in the tote by the two crimped side edges 70, 70' along the left side and 70", 70'" extending along the right side. These side crimped edges produce a block shaped tote having front and back surfaces as well as left and right surfaces and a base surface. The surfaces described herein, may be planar surfaces connected along edges to form a block shaped enclosure. The base of the tote shown in FIG. 7, as well as the front, back, and side surface are rectangular in shape, formed by the crimped edges and sleeve couplers. As shown in FIG. 7, the clear view portion 50 of the tote is more than 75% of the surface of the tote, as calculated by taking the area of each of the sides, or surfaces. The front, back and side surfaces, as well as a majority of the base are substantially the independent multilayer knitted metal fabric. Only the sleeve couplers along the base and the top-opening sleeve are not transparent or translucent.

Figure 8:
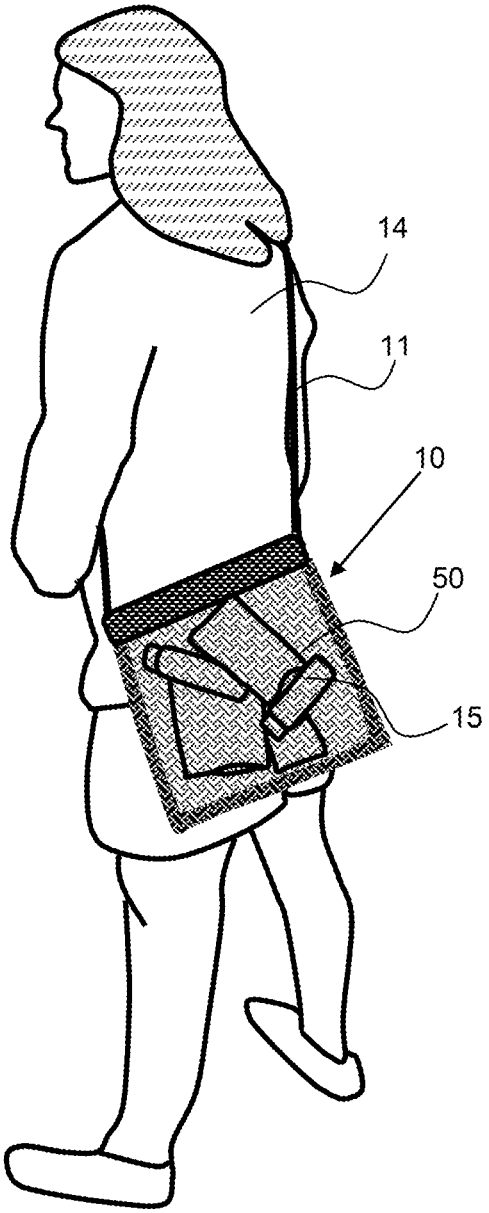
FIG. 8 shows a person carrying a tote of the present invention with contents clearly visible through the clear-view portion.

As shown in FIG. 8, a person 14 is carrying an exemplary tote 10 of the present invention by a strap 11. The exemplary tote has a clear-view portion 50 to allow inspection of items 15 in the tote.

Figure 9:
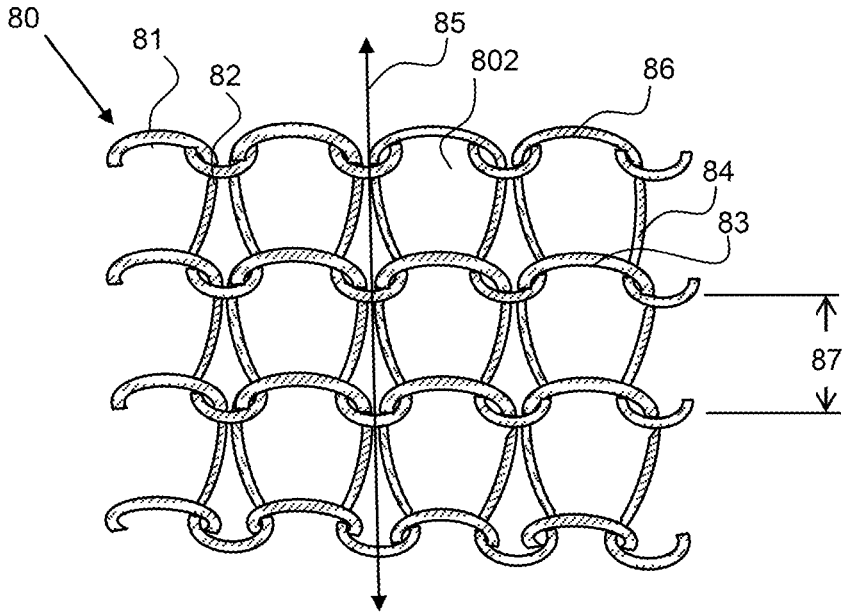
FIG. 9 shows an exemplary knitted metal having an interloping knit weave.
Figure 10:
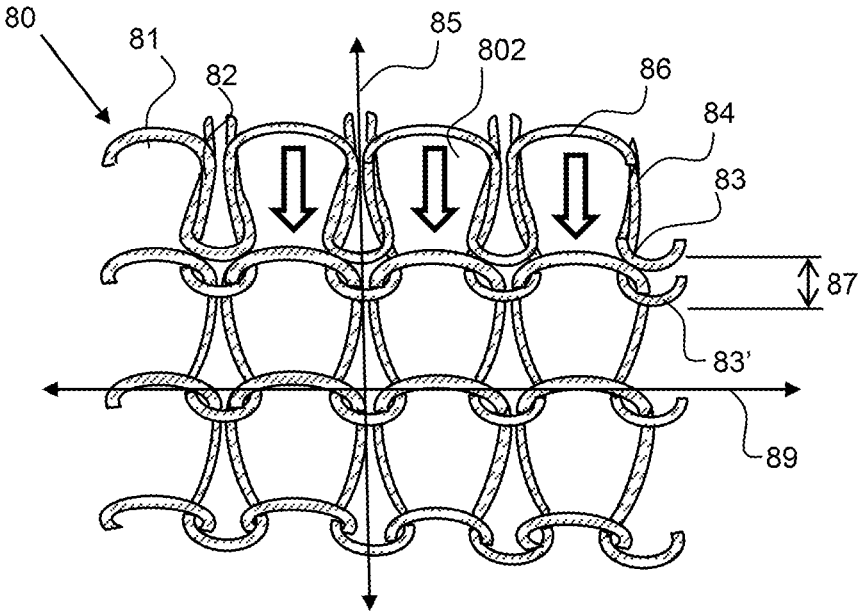
FIG. 10 shows an exemplary knitted metal having an interloping knit weave that is contracted along the loop axis.
Figure 11:
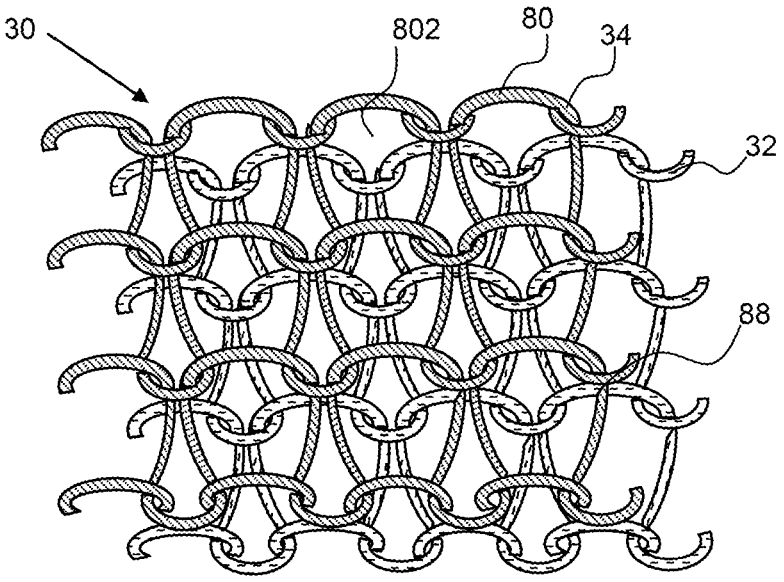
FIG. 11 shows a two-ply layer knitted metal layer, wherein each knitted metal layer has an interloping knit weave.

Referring now to FIGS. 9 to 11, an exemplary multilayer knitted metal fabric 80, has an interloping knit pattern. The knitted metal fabric comprises metal strands 81 that are coupled together by coupling loops 82. As shown the strands have a weft portion 83, or portion where they extend in the weft direction, or cross machine direction, and a warp portion 84, or portion where they extend in the warp direction, or machine direction. The coupling loops extend around two main loops 86 of the knitted fabric. The main loops are larger in dimension than the coupling loops in this exemplary knitted fabric. The machine direction distance between the coupling loops or the loop gap 87 enables movement and flexibility of the fabric in the loop axis 85, or axis of motion of the coupling loops 82. The loop gap distance when the fabric is stretched taut in the loop axis 85 may be about 2 mm or more, about 4 mm or more, about 6 mm or more, about 10 mm or more and any range between and including the values provided. As shown in FIG. 10, the coupling loops have slid in compression, or toward each other, over the main loops 86 to reduce the loop gap 87. This allows the fabric to be flexible in the loop axis direction, or an axis extending in the warp or machine direction. The fabric also some flexibility in the weft or cross machine direction or weft axis 89 when the coupling loops are larger with respect to the two metal strands coupled therein.

As shown in FIG. 11, an exemplary two-ply knitted metal layer or fabric 30 is an independent layered fabric 88 having two independent layers of knitted metal, a knitted metal inside layer 32 and a knitted metal outside layer 34. The two layers are not attached and can move independent of each other which makes it very difficult to cut through the fabric layer. The two fabric layers can slide over each other, and the strands of each of the fabric layers can move independent of each other. Each layer is flexible can move independently. These layers and the strands within each layer will slip and slide in response to force such as a compression force and prevent cutting.

As shown in FIGS. 9 to 11, the multilayer knitted metal fabric 80, has an interloping knit pattern forming openings 802 that have a density, (openings/inch) such as a density of about 60 to 90 opening/inch, wherein the openings are counted along the loop axis 85 or weft axis 89 of the fabric.

Figure 12:
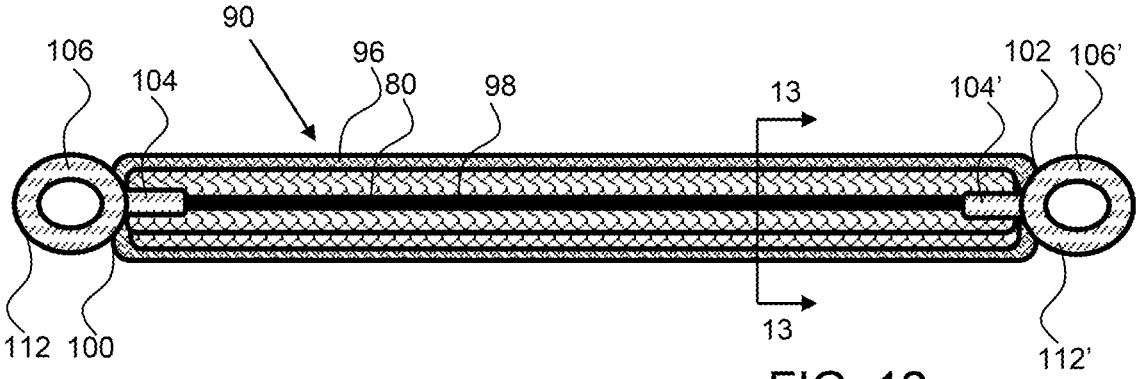
FIG. 12 shows a cross-sectional view of an exemplary lock cable comprising a knitted metal fabric coil.
Figure 13:
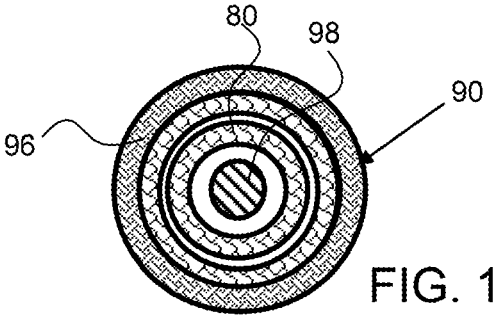
FIG. 13 shows a length cross-sectional view of an exemplary lock cable comprising a knitted metal fabric coil.
Figure 14:
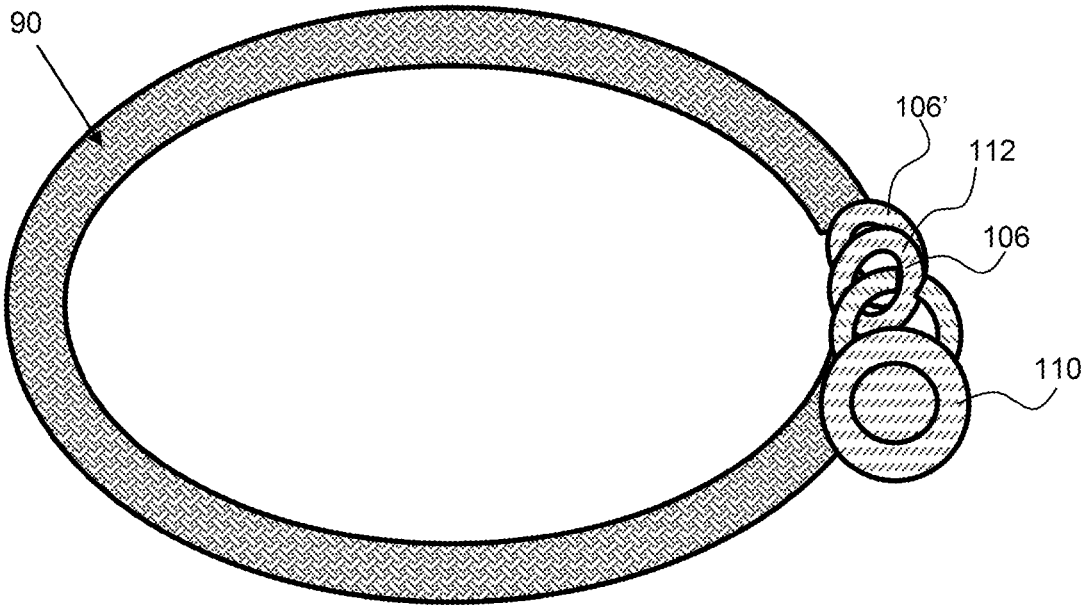
FIG. 14 shows a top view of an exemplary lock cable comprising a knitted metal fabric coil.
Figure 15:
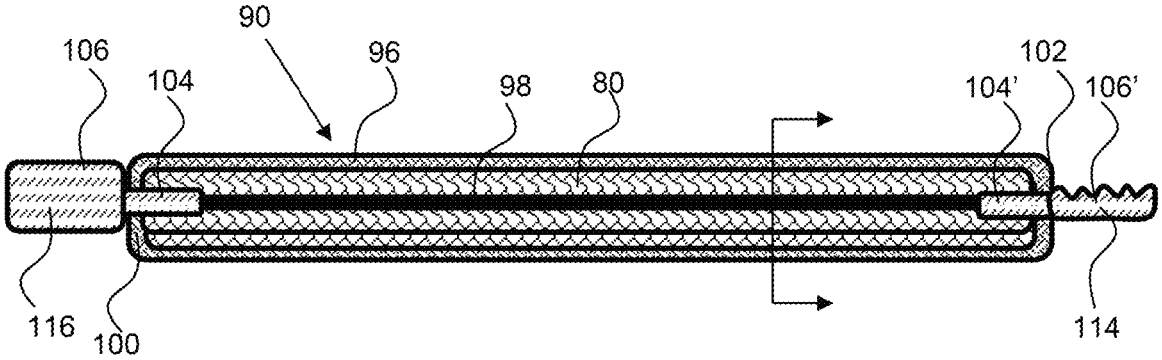
FIG. 15 shows a cross-sectional view of an exemplary lock cable comprising a knitted metal fabric coil.
Figure 16:
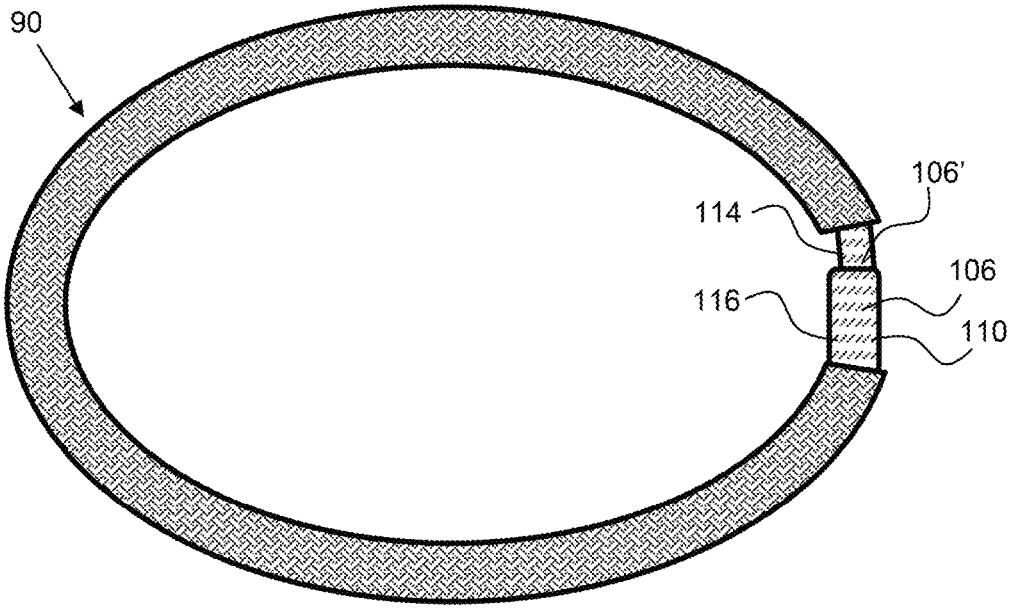
FIG. 16 shows a top view of an exemplary lock cable comprising a knitted metal fabric coil.
Figure 17:
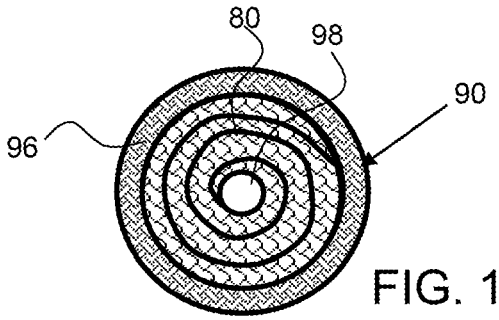
FIG. 17 shows a length cross-sectional view of an exemplary lock cable comprising a knitted metal fabric coil.
Figure 18:
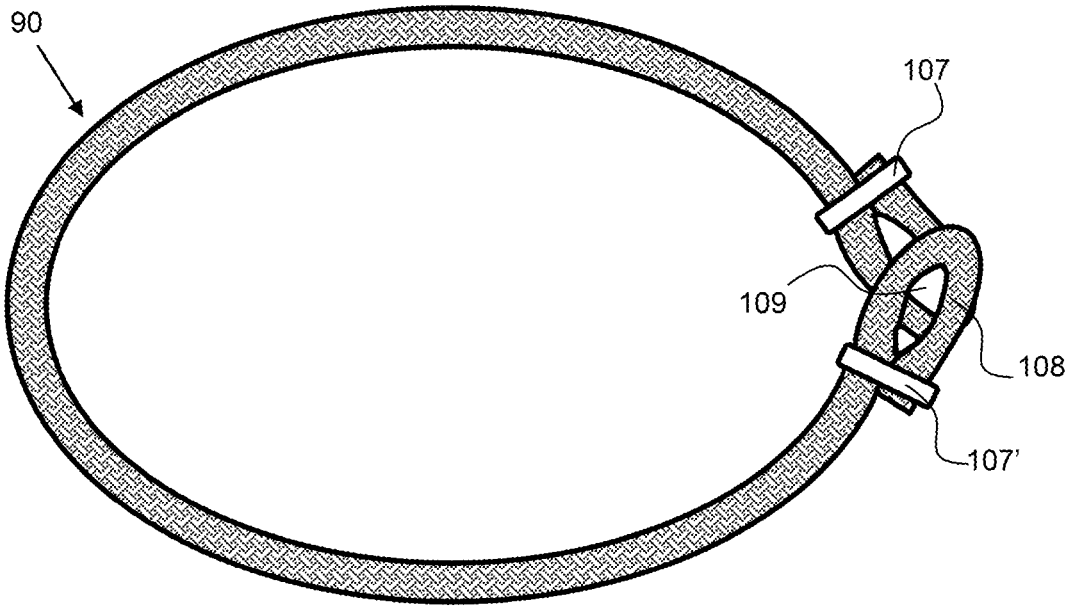
FIG. 18 shows a top view of an exemplary lock cable comprising a knitted metal fabric coil.

Referring now to FIGS. 12 to 18, an exemplary lock cable 90 comprises a multilayer knitted metal fabric 80, such as a two-ply knitted metal layer. A fabric layer 96 extends around the metal fabric and a lock coupler extension 98 may extend along the length of the lock cable to a lock portion, such as a lock receiver portion 116 and to a lock insertion portion 114, as shown in FIG. 15. The lock coupler extension extends between lock rings 112, 112' as shown in FIG. 12. The lock coupler extension 98 may couple with a lock interior portion 104 that extends into the multilayer metal fabric to prevent disconnection or tampering with the lock coupler extension. The lock exterior portions 106, such as the lock receiver or lock rings extend out from the interior of the lock cable. The lock coupler extension may be a cable, such as a hardened metal or braided cable or other flexible and cut resistance cable. The lock cable has a length from a first end 100 to a second end 102. As shown in FIG. 14, a lock 110 may be inserted through apertures in the lock exterior portion 106, or lock rings 112, to secure the lock cable around an article. As shown in FIG. 16, the lock insertion portion 114 may be inserted into the lock receiver portion 116 to coupled the lock cable 90 around an article. As shown in FIG. 18, a lock cable 90 may comprise a looped end 108 with a crimp 107 swaged around the loop extended end of the cable to produce an aperture 109. A pad lock or other suitable lock may be configured through the aperture to secure the lock cable 90 around an article.

As shown in FIGS. 13 and 17, the lock cable may comprise a multilayer metal fabric, and preferably multiple layers of a knitted metal fabric 80, as this type of metal fabric is highly resistant to cut-through. As shown in FIG. 13, the multilayer knitted metal fabric 80 and a fabric layer 96 may be layered or rolled to form the lock cable extension. A lock coupler extension 98, such as a cut resistant cable may be centrally located in the middle of the lock cable with the multilayer metal fabric configured around it. As shown in FIG. 17, the multilayer metal fabric may be a jelly-roll within the lock cable.

Figure 19:
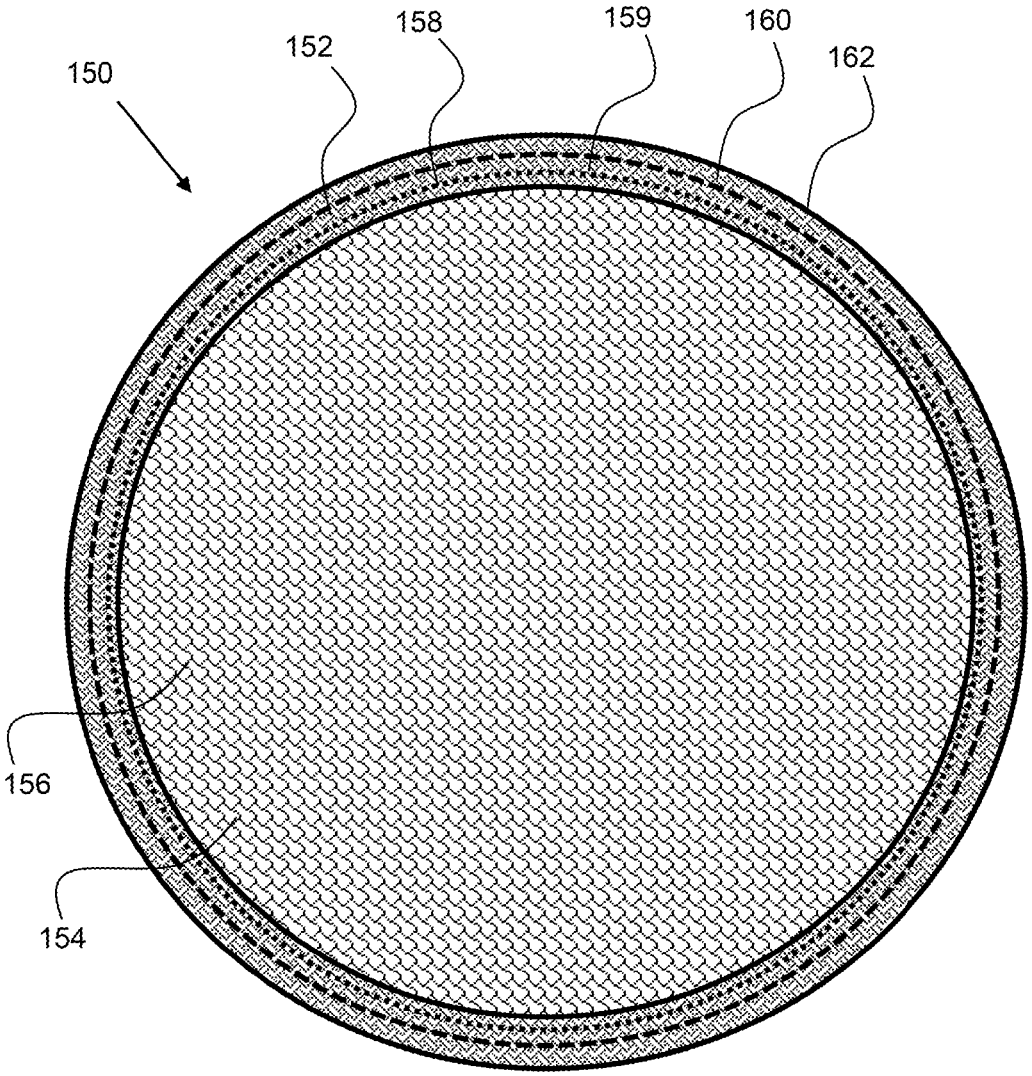
FIG. 19 shows an exemplary insect flying disc device.

As shown in FIG. 19, an exemplary insect flying disc 150 comprises a metal fabric 158 configured in a circular shape with a sleeve 152 extending therearound. The central portion may be a multilayer metal fabric 154 and may be a clear-view area 156, that is highly translucent, as described herein. The sleeve 152 may be a fabric sleeve 158 that extends around the metal fabric and is secured with a stitch 159. A resilient ring 160 such as a spring steel ring 162 may be configured within the sleeve and allow the insect flying disc to be folded to a smaller dimension for storage. The resilient ring will pop open the insect flying disc 150 to the disc shape as shown when released from a restrained orientation. The insect flying disc can be thrown to capture insects in the air and may land over insects or other animals to keep them retained under the flying disc.

Figure 20:
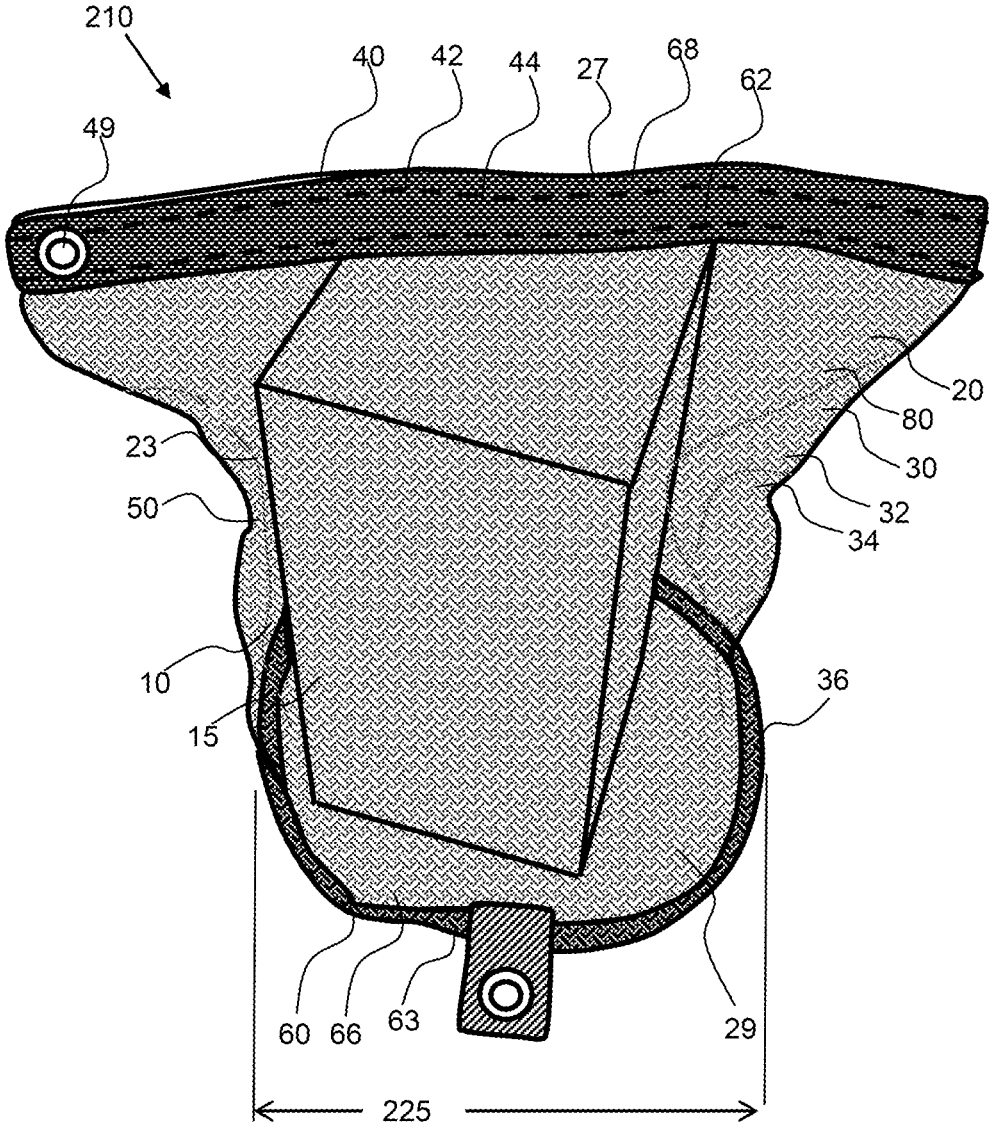
FIG. 20 shows a perspective view of an exemplary tote, or can tote of the present invention having a round bottom to better enable the can tote to stand upright.

As shown in FIG. 20, an exemplary tote 10, or can tote 210 has a round or circular shaped base 29 and a cylindrically shaped fabric sleeve 23. The base may be planar to better enable the can tote to stand upright, or be free-standing. The exemplary tote 10 comprises a multilayer knitted metal fabric 80 that is translucent having a high open area and is cut resistant. The multilayer knitted metal fabric may be a fabric sleeve 23 consisting of the multilayer knitted metal fabric in a continuous sleeve, with no seams along the length of the sleeve, wherein the multilayer knitted metal fabric extends continuously around the perimeter of the sleeve. An exemplary sleeve has a free end at the top and bottom. A clear view portion 50 of the tote, or area that is highly translucent, is configured between the top opening sleeve 44 and the base 29, and allows items 15 retained therein to be clearly viewed through the multilayer knitted metal fabric.

The multilayer knitted metal fabric 80 may be a two-ply knitted fabric 30, comprising independent and unattached layers of an inside layer of knitted metal fabric 32 and outside layer of knitted metal fabric 34, to produce a cut resistant tote having a clear-view portion 50. In an exemplary embodiment, these two layers are unattached in the clear-view portion to allow independent movement to further increase cut through resistance. The exemplary can tote has a top opening 40 with a closure feature 42, such as hook-and-loop fastener material 43 or zipper. A top opening sleeve 44, such as a fabric 62, extends over the knitted metal fabric to encapsulate the top edge of the knitted metal fabric. A stitch 68 may extend through this fabric and the multilayer knitted metal fabric 80 to secure the two components together. A grommet 49 extends through the top opening sleeve and the knitted metal fabric to secure the top opening sleeve together and to provide a means to tether the can tote, such as by a rope or cable, to an object. The grommet provides a means to secure a strap, clip, a karabiner or other fastener to the tote. The tote has a height from the top 27 to the base 29, or bottom, and a diameter 225 at the base. The base forms a planar surface to better enable the tote-can to stand upright.

A base coupling 60 couples the base 29 to the fabric sleeve 23. The base coupling is an inverted seam 66, wherein the multilayer knitted metal fabric 80 has a base crimp that folds the multilayer knitted metal fabric 80 inward toward the interior of the tote. A sleeve coupler 63, such as fabric 62 extends over the free ends 36 of the multilayer fabric and is secured to each of the free ends, as generally shown in FIG. 2. This inverted seam keeps the free ends of the metal fabric pointed inward.

Figure 21:
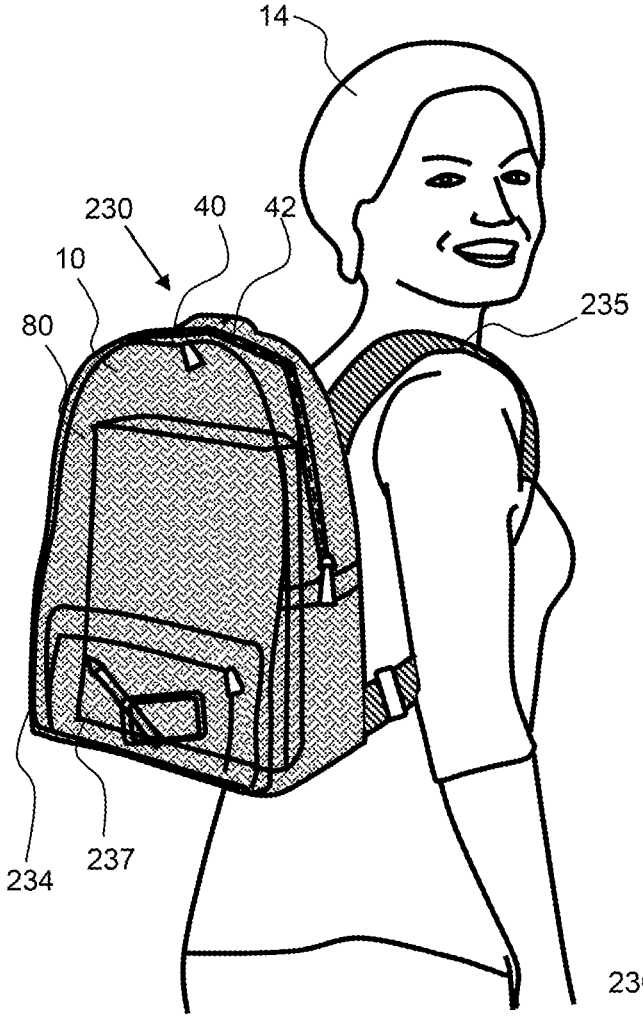
FIG. 21 shows a perspective view of an exemplary backpack comprising a knitted metal fabric to allow viewing of articles therein.
Figure 22:
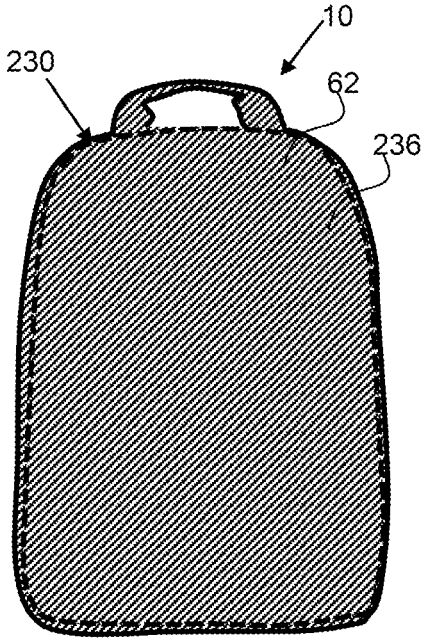
FIG. 22 shows a front side view of the exemplary backpack shown in FIG. 21 with a fabric configured on the front side.

Referring now to FIGS. 21 and 22, an exemplary cut resistant and highly translucent tote 10 may be incorporated into a backpack 230 comprising a multilayer knitted metal fabric 80 to allow viewing of articles therein. The backpack has a plurality of shoulder straps 235 configured to extend around the shoulders of a person. The backpack may be worn as shown on the person's back or alternatively in front of the person. The cut resistant and highly translucent tote 10 may be configured on a first side 234 of the backpack. A top opening 40 has a closure feature 42, such as a zipper. A smaller auxiliary compartment 237 is coupled to the backpack tote and may have a separate opening closure feature, such as a zipper. As shown, smaller articles are retained in the auxiliary compartment. As shown in FIG. 22, a fabric 62 may be configured on the front side or second side 236 of the backpack for comfort.

Figure 23:
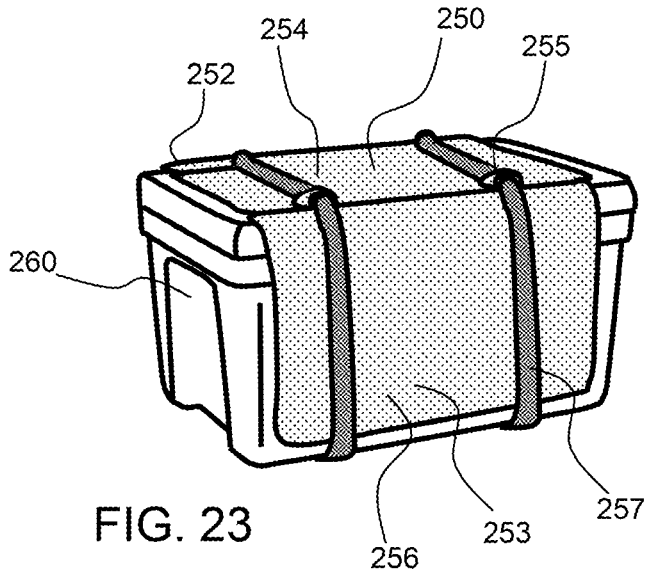
FIG. 23 shows perspective view of a cooler with a cooler utensil tote configured over the cooler.
Figure 24:
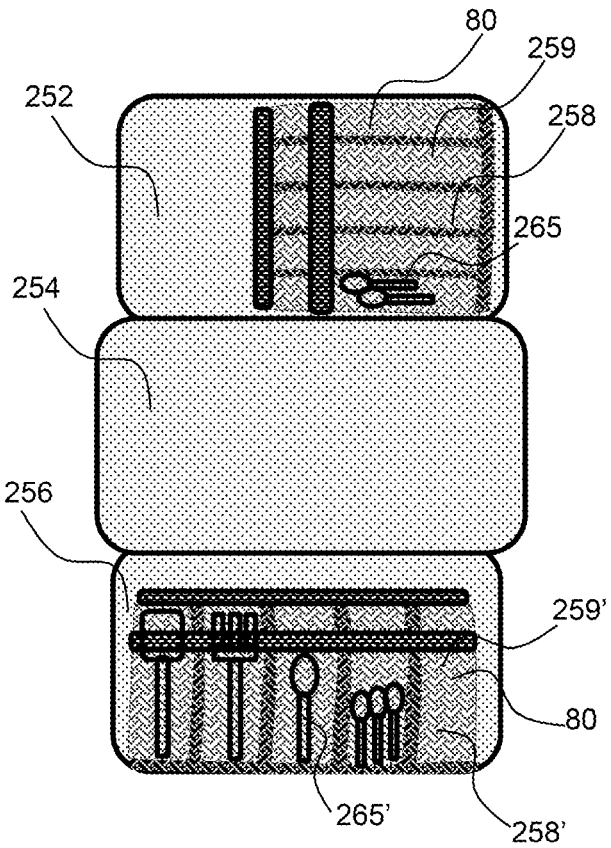
FIG. 24 shows an inside view of a cooler utensil tote having a cut resistant and highly translucent tote multilayer knitted metal fabric.
Figure 25:
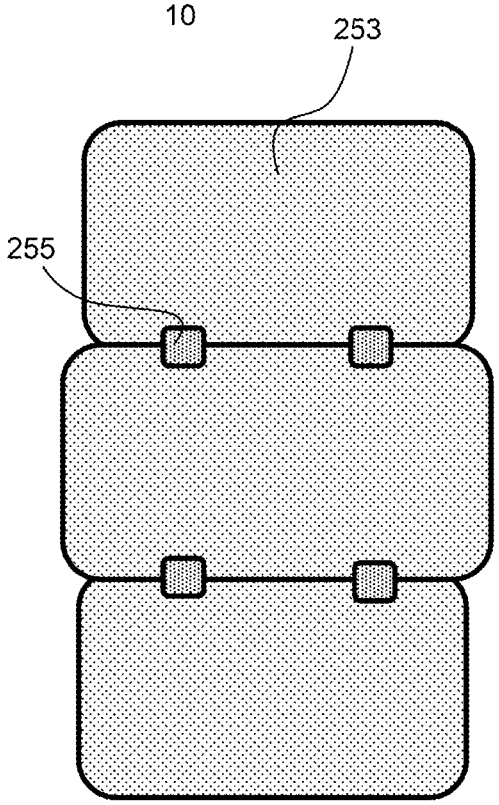
FIG. 25 shows an outside view of the cooler utensil tote shown in FIG. 24, wherein the outside is a fabric.

Referring now to FIGS. 23 to 25, an exemplary cut resistant and highly translucent tote 10 may be incorporated into a cooler utensil tote 250 having a multilayer knitted metal fabric 80 configured to retain utensils 265, as shown in FIG. 24. A first cut resistant and highly translucent tote portion 259 is configured on a first side portion 252 and comprises sleeves 258 for receiving and retaining utensils 265. A second cut resistant and highly translucent tote portion 259' is configured on a second side portion 256 and comprises sleeves 258' for receiving and retaining utensils 265'. A top portion 254 of the cooler utensil tote 250 is configured between the first side portion and the second side portion and is configured to extend over the top of the cooler.

FIG. 23 shows a cooler 260 with the cooler utensil tote 250 draped over and coupled to the cooler by straps 257. A plurality of loops 255 are configured on the outside 253 of the cooler utensil tote to enable retaining the cooler utensil tote to the cooler by the straps. The cooler utensil tote 250 has a first side portion 252, a top portion 254 and second side portion 256. The first side portion 252 is configured to extend down over the first side of the cooler, the top portion 224 is configured to extend over the top of the cooler and the second side portion 226 is configured to extend down over the second side of the cooler. A first cut resistant and highly translucent tote portion 259 is coupled to the first side portion and a second cut resistant and a second cut resistant and highly translucent tote portion 259' is coupled to the second side portion, as shown in FIG. 24. Note that the sleeves 258, 258' may extend horizontally or vertically, respectively, as shown. These sleeves are configured on an inside surface of the cooler utensil tote 250. The outside surface 253 may comprise a fabric and this fabric may be waterproof and/or a fast drying fabric.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A cut resistant and translucent tote comprising:

a) a multilayer knitted metal fabric comprising:

i) a knitted metal outside layer;

ii) a knitted metal inside layer;

b) a top opening having an opening sleeve that extends over the outside and inside layers of knitted metal;

c) a base, d) a clear-view portion configured between the opening sleeve and the base that is translucent; and e) a height from the opening to the base along a height axis;

wherein the multilayer knitted metal fabric has an opening density along a weft axis of between 50 and 80 openings per linear inch and a wire diameter between 0.008" and 0.11".

2. The cut resistant and translucent tote of claim 1, wherein the opening density is between 70 to 80 openings per linear inch along the weft axis of the multilayer knitted metal fabric.

3. The cut resistant and translucent tote of claim 1, wherein the knitted metal inside layer and the knitted metal outside layer are both an interloping knit comprising a loop axis.

4. The cut resistant and translucent tote of claim 3, wherein the loop axis of both the knitted metal inside layer and knitted metal outside layer extends along the height of the tote.

5. The cut resistant and translucent tote of claim 1, wherein the tote has a perimeter and wherein the clear-view portion extends completely around the perimeter of the tote.

6. The cut resistant and translucent tote of claim 1, wherein the clear-view portion has an open area of at least 50%.

7. The cut resistant and translucent tote of claim 1, wherein the multilayer knitted metal fabric is a fabric sleeve; wherein the multilayer knitted metal fabric is continuous around the perimeter.

8. The cut resistant and translucent tote of claim 1, wherein the base is a circular base and wherein the cut resistant and translucent tote is free standing.

9. The cut resistant and translucent tote of claim 8, wherein the base comprises:

a) a multilayer knitted metal fabric comprising:

i) a knitted metal outside layer; and ii) a knitted metal inside layer.

10. The cut resistant and translucent tote of claim 8, wherein the multilayer knitted metal fabric is a fabric sleeve.

11. The cut resistant and translucent tote of claim 1, wherein the tote comprises shoulder straps and is configured as a backpack.

12. The cut resistant and translucent tote of claim 11, wherein the backpack has an auxiliary compartment.

13. The cut resistant and translucent tote of claim 11, wherein the backpack has a fabric configured on a front side.

14. The cut resistant and translucent tote of claim 1, wherein the tote is configured as a cooler utensil tote configured to be coupled to a cooler.

15. The cut resistant and translucent tote of claim 14, wherein the cooler utensil tote comprises a hoop configured to retain a strap to couple the cooler utensil tote to said cooler.

16. The cut resistant and translucent tote of claim 14, wherein the cooler utensil tote has a first side portion, a top portion and a second side portion, wherein the first side portion is configured to extend down a first side of said cooler, the top portion is configured to extend over a top of said cooler and the second side portion is configured to extend down a second side of said cooler.

17. The cut resistant and translucent tote of claim 16, wherein the cooler utensil tote has a first cut resistant and highly translucent tote portion configured on the first side portion and a second cut resistant and highly translucent tote portion configured on the second side portion of the cooler utensil tote.

18. The cut resistant and translucent tote of claim 17, wherein the first cut resistant and highly translucent tote portion comprises sleeves for receiving utensils.

19. The cut resistant and translucent tote of claim 1, wherein the multilayer knitted metal fabric is an independent layered fabric in the clear-view portion of the tote, wherein the knitted metal inside layer and knitted metal outside layer are unattached.

20. The cut resistant and translucent tote of claim 1, wherein the clear-view portion consists of the knitted metal inside layer and the knitted metal outside layer.

* * * * *